US012765700B2

(12) United States Patent
Merritt

(10) Patent No.: US 12,765,700 B2
(45) Date of Patent: Oct. 20, 2026

(54) ADJUSTABLE INSULATED GLASS BEVERAGE WRAP

(71) Applicant: Teresa Tompkins Merritt, Fort Lauderdale, FL (US)

(72) Inventor: Teresa Tompkins Merritt, Fort Lauderdale, FL (US)

( * ) Notice: Subject to any disclaimer, the term of this patent is extended or adjusted under 35 U.S.C. 154(b) by 0 days.

(21) Appl. No.: 18/828,683

(22) Filed: Sep. 9, 2024

(65) Prior Publication Data

US 2025/0082120 A1 Mar. 13, 2025

Related U.S. Application Data

(60) Provisional application No. 63/581,288, filed on Sep. 8, 2023.

(51) Int. Cl.
*B65D 81/38* (2006.01)
*A47G 19/12* (2006.01)

(52) U.S. Cl.
CPC ..... *A47G 19/127* (2013.01); *B65D 81/3876* (2013.01)

(58) Field of Classification Search
CPC ..... B65D 81/3876; B65D 81/3879; B65D 81/3886; B65D 81/3865; B65D 2203/00; A47G 2023/0291; A47G 19/2288; A47G 2023/0275; A47G 23/0216; F25D 2331/805; F25D 3/08; F25D 2331/809
USPC ..... 220/737, 753, 592.24; 229/403; 62/530
See application file for complete search history.

(56) References Cited

U.S. PATENT DOCUMENTS

| | | | | |
|---|---|---|---|---|
| 4,282,279 | A * | 8/1981 | Strickland | B65D 25/34 206/139 |
| 4,413,481 | A | 11/1983 | Thomas | |
| 4,918,840 | A | 4/1990 | Nardulli | |
| 5,169,025 | A | 12/1992 | Guo | |
| 5,320,249 | A | 6/1994 | Strech | |
| D429,447 | S | 8/2000 | Prag | |
| 6,123,220 | A * | 9/2000 | Williams | A47G 23/03 220/737 |
| 7,228,987 | B2 | 6/2007 | Jones | |
| 7,337,915 | B1 | 3/2008 | Weldon | |
| D642,432 | S | 8/2011 | Williams | |
| 8,544,678 | B1 | 10/2013 | Hughes | |

(Continued)

FOREIGN PATENT DOCUMENTS

| | | |
|---|---|---|
| CN | 201533784 | 7/2010 |
| DE | 3323175 | 1/1985 |

(Continued)

*Primary Examiner* — King M Chu
(74) *Attorney, Agent, or Firm* — The Concept Law Group, PA; Scott D. Smiley; Scott M. Garrett

(57) ABSTRACT

An insulated glass beverage wrap includes a sheet-like body having opposing ends that are connected by a top edge and a bottom edge. The body is made of an insulative material that can be stretched. The body has a first closure structure at one end of the wrap body and a second closure structure at the opposite, second end of the body. When the wrap is placed around a glass, the ends overlap, allowing the first and second closure structures to mate, thereby helping to retain the wrap on the glass. The ends are shaped to that the top edge of the wrap provides a space for a person to drink from the glass.

14 Claims, 13 Drawing Sheets

(56) References Cited

U.S. PATENT DOCUMENTS

| | | | | |
|---|---|---|---|---|
| 8,870,018 | B2 * | 10/2014 | Cook | A47G 23/0241 229/87.01 |
| D856,090 | S | 8/2019 | Anderson | |
| 11,206,885 | B2 | 12/2021 | Sharpe | |
| 2005/0173445 | A1 | 8/2005 | Sumerson et al. | |
| 2006/0186129 | A1 | 8/2006 | Allnutt et al. | |
| 2007/0068944 | A1 | 3/2007 | McKinney et al. | |
| 2022/0248884 | A1 * | 8/2022 | Rollett | A01N 25/34 |

FOREIGN PATENT DOCUMENTS

| | | |
|---|---|---|
| JP | 2010046437 | 3/2010 |
| JP | 2020203058 | 12/2020 |
| KR | 20100010620 | 10/2010 |
| KR | 20170115348 | 10/2017 |
| KR | 102016012 | 8/2019 |

* cited by examiner

800B

800A

ADJUSTABLE INSULATED GLASS BEVERAGE WRAP

CROSS-REFERENCE TO RELATED APPLICATION

This application claims priority to U.S. Provisional Patent Application No. 63/581,288, filed Sep. 8, 2023, the entirety of which is hereby incorporated by reference.

FIELD OF THE INVENTION

The present invention relates generally to beverage insulators, and, more particularly, relates to an adjustable and removable insulated wrap for various styles of beverage glassware.

BACKGROUND OF THE INVENTION

There are a number of beverage insulators on the market which are intended to surround a beverage container and both insulate the beverage as well as to provide a comfortable surface for the user, or drinker of the beverage, to hold. That is, the beverage insulator avoids condensation that would normally occur on the outside of a cold beverage container from wetting the hands of the person holding the insulated beverage. This is especially true when the beverage is being consumed outside in warm, humid weather. One of the most common beverage insulators is a cylindrical foam insulator sleeve that is sized to fit around a standard sized beverage can or bottle. For example, in the U.S. a 12-ounce can is a standard for soft drink, sparkling water, and beer, and these all have a common diameter and height. Thus, a foam sleeve, known by the common name "koozie," can be sized to fit around the standard sized can or bottle. Similarly, there are elastic insulators for wine glasses or similar stemware called "woozies" that are sized for a standard sized glass. While these kinds of sleeves are very effective, they only fit well on one size of container. In addition, being in a sleeve configuration, they can be somewhat difficult to remove from a container.

A problem exists when it comes to other forms of beverage containers, and specifically beverage glasses. A beverage glass can be made of glass, or another material, can be configured in a wide variety of shapes and sizes. Thus, a standard sized insulator would not fit on a variety of differently sized beverage glasses.

Therefore, a need exists to overcome the problems with the prior art as discussed above.

SUMMARY OF THE INVENTION

In accordance with some embodiments of the inventive disclosure, there is provided an insulated beverage glass wrap that includes a body comprised of a sheet of an insulating material and including a first side and a second side. The body has a first end and a second end that is opposite the first end, the first end having a defining a first end edge and the second end defining a second end edge. The body further includes a top edge along a top of the body from the first end to the second end and a bottom edge along a bottom of the body from the first end to the second end. The body further includes a first closure structure positioned on the body adjacent the first end and a second closure structure positioned on the body adjacent the second end and that is configured to engage the first closure structure. The body is configured to be wrapped around a beverage glass such that the first side is against an external surface of the beverage glass and the first end and the second end meet such that the second closure structure is engaged with the first closure structure to thereby retain the insulated beverage glass wrap on the beverage glass.

In accordance with a first feature, the body is rounded where the top edge transitions to the first end and the second end such that when the insulated beverage glass wrap is wrapped around the beverage glass there is a downward deviation along the top edge where the first end and second end meet to provide a drinking location.

In accordance with a first feature, the first closure structure is a loop-fabric portion disposed on the second side of the body, and the second closure structure is a hook-fabric portion disposed on the first side of the body.

In accordance with a first feature, the loop-fabric portion is larger than the hook-fabric portion.

In accordance with a first feature, the first closure structure a plurality of buttons disposed on the second side of the body, and the second closure structure is a loop, and wherein each button of the plurality of buttons is positioned at different positions along the body.

In accordance with a first feature, the bottom edge has a shorter length from the first end to the second end than the top edge.

In accordance with a first feature, there is further included at least one pleat adjacent the bottom edge.

In accordance with a first feature, the top edge is at least five times as long as the bottom edge, and wherein the beverage glass is a martini glass.

In accordance with a first feature, there is further included at least one suction cup on the first side of the body that is configured to hold the body to the external surface of the martini glass.

In accordance with a first feature, there is further included a continuous cuff sewn around an entirety of the top edge, first end, bottom edge, and second end.

In accordance with some embodiments of the present inventive disclosure, there is provided an insulated beverage glass wrap that includes a body comprised of a sheet of an insulating, moisture impermeable material, and including a fabric sheath around the insulating, moisture impermeable material, and having a first side and a second side. The body has a first end and a second end that is opposite the first end, and a top edge along a top of the body from the first end to the second. The body is rounded where the top edge transitions to the first end, and the body is rounded where the top edge transitions to the second end. The body includes a bottom edge along a bottom of the body from the first end to the second end. There is a first closure structure positioned on the body adjacent the first end, and a second closure structure positioned on the body adjacent the second end that is configured to engage the first closure structure. The body is configured to be wrapped around a beverage glass such that the first side is against an external surface of the beverage glass and the first end and the second end meet such that the second closure structure is engaged with the first closure structure to thereby retain the insulated beverage glass wrap on the beverage glass. A "V" shaped notch is formed by the body at an overlap of the first end and the second end to form a drinking location between a top rim of the beverage glass and the body.

Although the invention is illustrated and described herein as embodied in an insulated glass beverage wrap, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the article being referenced. The term "elongated" in this context is to be understood as referring to the longest dimension of an article being referenced, with width being a dimension in the opposite direction of the elongated direction. Those skilled in the art can understand the specific meanings of the above-mentioned terms in the embodiments of the present invention according to the specific circumstances.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1A:
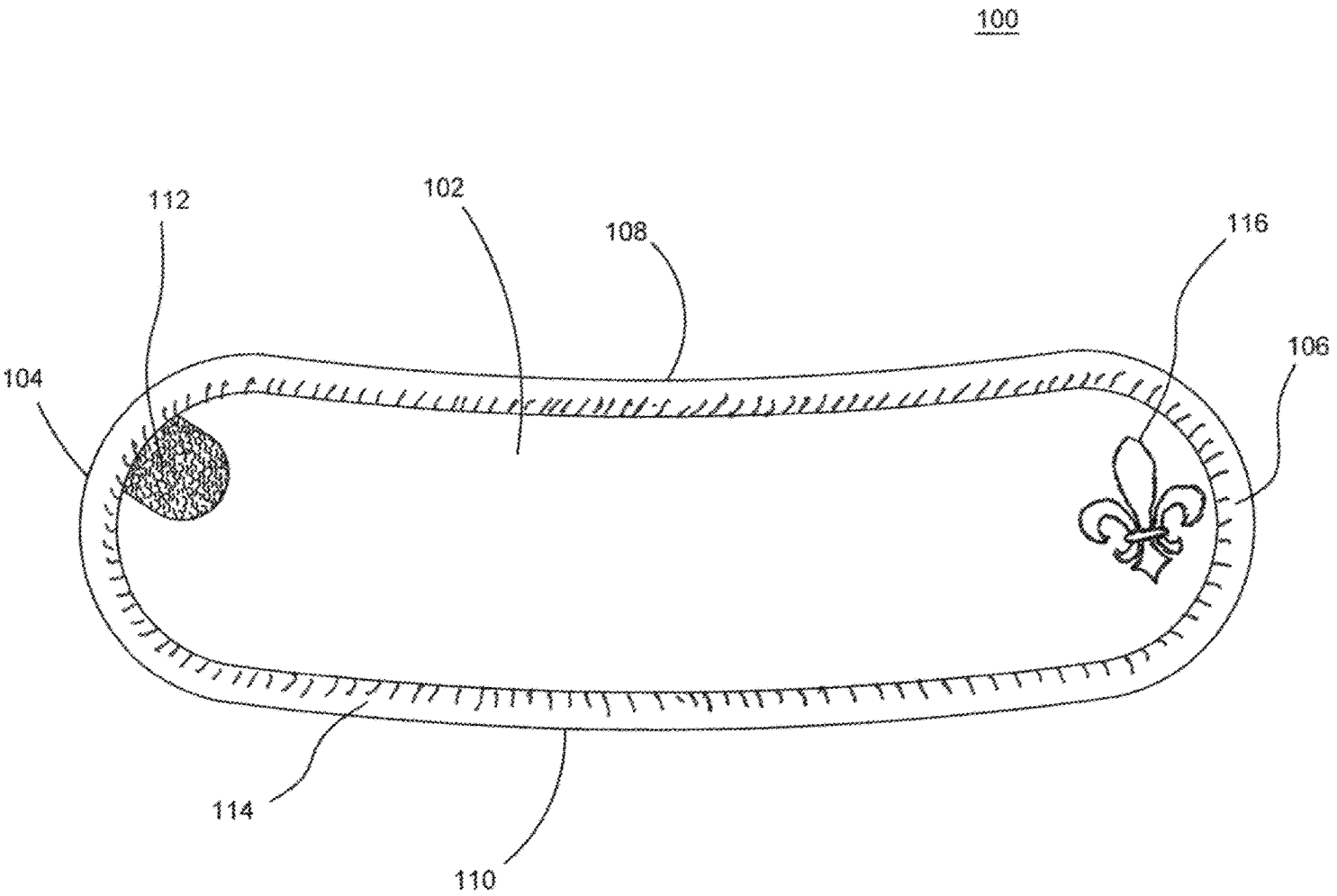
FIG. 1A is a plan view of a first side of an insulated glass beverage wrap, in accordance with some embodiments of the inventive disclosure.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient insulated beverage glass wrap. The term "glass" as used here can refer to beverage containers actually made of glass, but the term is meant more broadly to include beverage containers of different materials, including plastic beverageware. In general, the inventive insulated beverage wrap is configured to wrap around various differently shaped and sized beverage containers to keep the beverage at a desired temperature longer than if the glass is not wrapped, as well as to prevent condensation from creating water puddles on surfaces and wet hands of the person holding the glass. The disclosed inventive insulated glass beverage wrap is especially suited for cocktail and wine type glasses, which come in a wide variety of shapes and sizes. Accordingly, one advantage of the disclosed insulated glass beverage wrap is that it can fit a wide variety of differently-sized glasses.

FIG. 1A is a plan view of a first side 100 of an insulated glass beverage wrap, in accordance with some embodiments of the inventive disclosure. The insulated glass beverage wrap includes a body 102 that is made of an insulating material, such as, for example, synthetic foam rubber such as that sold under the trade name NEOPRENE. The body 102 can be made of a closed cell foam material that is resilient, and that can be stretched at least somewhat. The insulating material can be covered with a sheath of fabric, and the body 102 as a whole, including the sheath fabric, can stretch and return to its original shape once the released from the stretching force. The body 102 is, in a general, a sheet configuration, having a generally uniform thickness across the body 102. The thickness can vary based on a specific application, but it is contemplated that the body can be on the order of 1/16 of an inch to half an inch in thickness. Further, the material of the body 102 can include a moisture impermeable portion so as to prevent moisture from passing through the body 102. The body 102 has an elongated direction, from a first end 104 to a second end 106 that is opposite the body from the first end. The ends 104, 106 define end edges that span the height of the body 102, from a bottom edge 110 to a top edge 108. The top and bottom edges 108, 110 run from the first end 104 to the second end 106. The ends 104, 106 can be rounded or arcuate in a direction from the top edge 108 to the bottom edge 110. Further, the top edge 108 and bottom edge 110 can likewise have a slight arc contour in a direction from the first end 104 to the second end 106. Generally, the arc shape of the top edge 108 and the bottom edge 110 will follow each other, which the rounded ends 104, 106 extend outward in opposite directions.

Figure 1B:
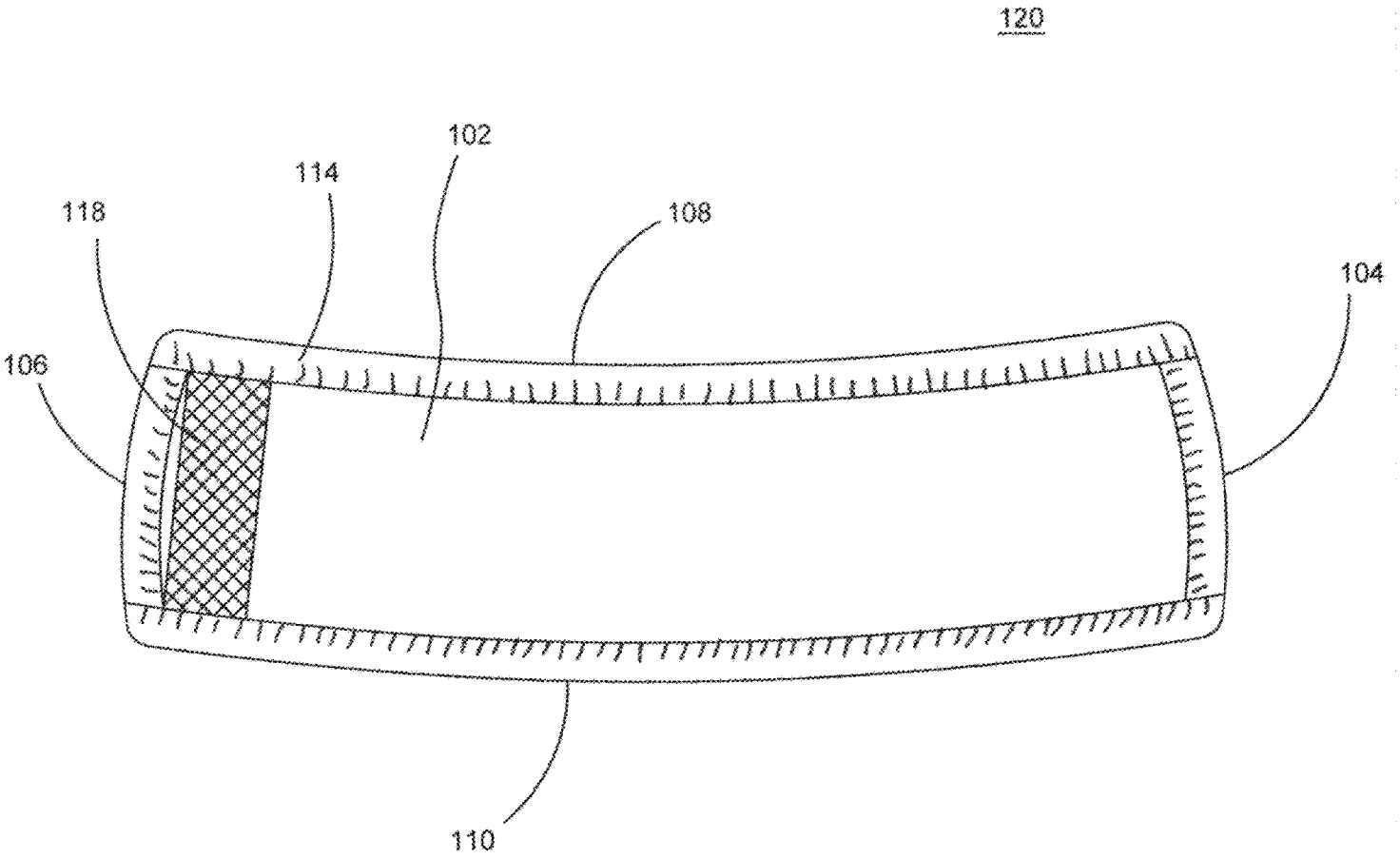
FIG. 1B is a plan view of a second side of the insulated glass beverage wrap of FIG. 1A, in accordance with some embodiments of the inventive disclosure.

Around the perimeter of the body 102 that can be a continuous cuff 114 sewn into the sheath fabric to prevent the body from fraying or otherwise degrading with use. The cuff 114 is formed by applying stitching around the perimeter of the body, include the ends 104, 106 and the top and bottom edges 108, 110. A first closure structure 112 can be disposed on the first side 100 of the body 102 adjacent the first end 104. The first closure structure 112, in this example, can be a loop-fabric portion for a hook and loop closure, such as that known by the trade name VELCRO. Additionally, there can decorative indicia 116 placed on the first side 100 of the body 102. The first side 100 is the side of the insulated glass beverage wrap that is intended to face outward from the glass around which it is wrapped, thus the indicia 116 can be viewed by people when the insulated glass beverage wrap is in use. FIG. 1B is a plan view of a second side 120 of the insulated glass beverage wrap of FIG. 1A, in accordance with some embodiments of the inventive disclosure. The second side 120 is intended to be against the external surface of the beverage glass around which the insulated beverage glass wrap is wrapped. There is a second closure structure 118 placed on the second side adjacent the second end 106. The second closure 118 structure is intended to mate with the first closure structure 112 to hold the insulated glass beverage wrap on a beverage glass. When the body 102 is wrapped around a glass, with the second side 120 against the exterior of the of the beverage glass, and the second end 106 will overlap the first end 104, allowing the second closure structure 118 to mate with the first closure structure 112, and thereby retain the insulated beverage glass wrap on the beverage glass.

Figure 2A:
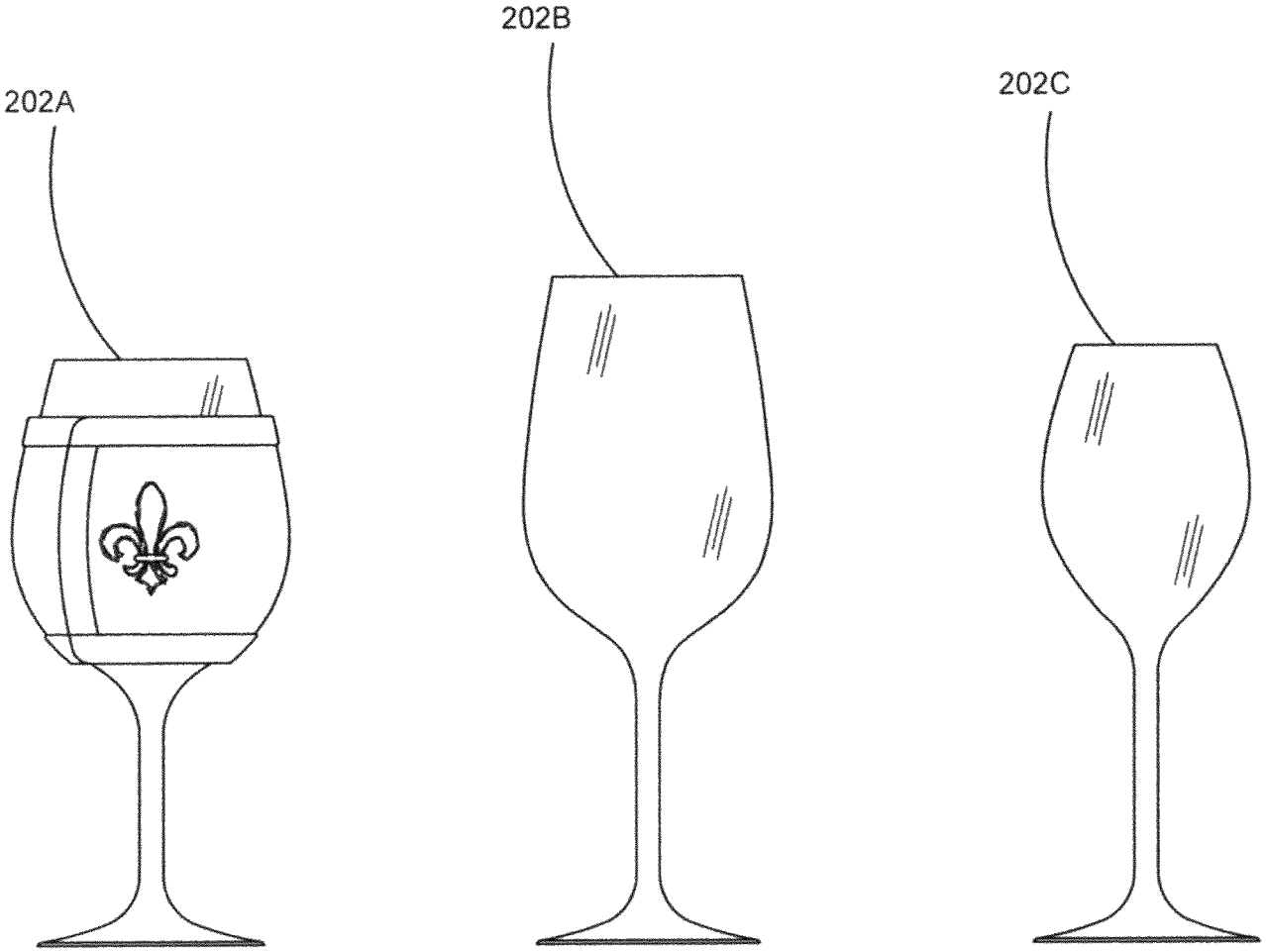
FIGS. 2A, 2B, and 2C show the insulated glass beverage wrap of FIGS. 1A-1B placed on various sized beverage glasses, in accordance with some embodiments of the inventive disclosure.
Figure 2B:
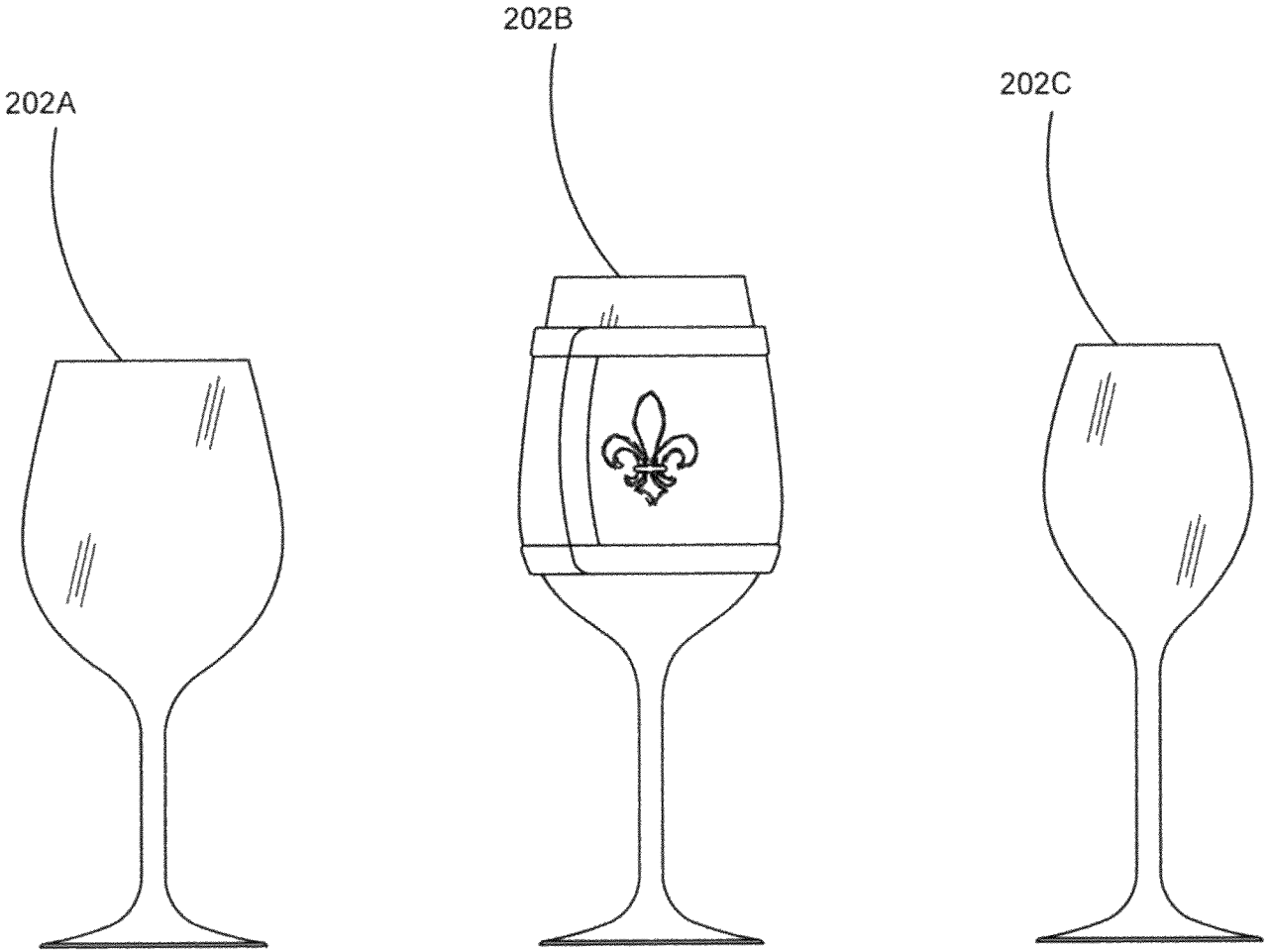
Figure 2C:
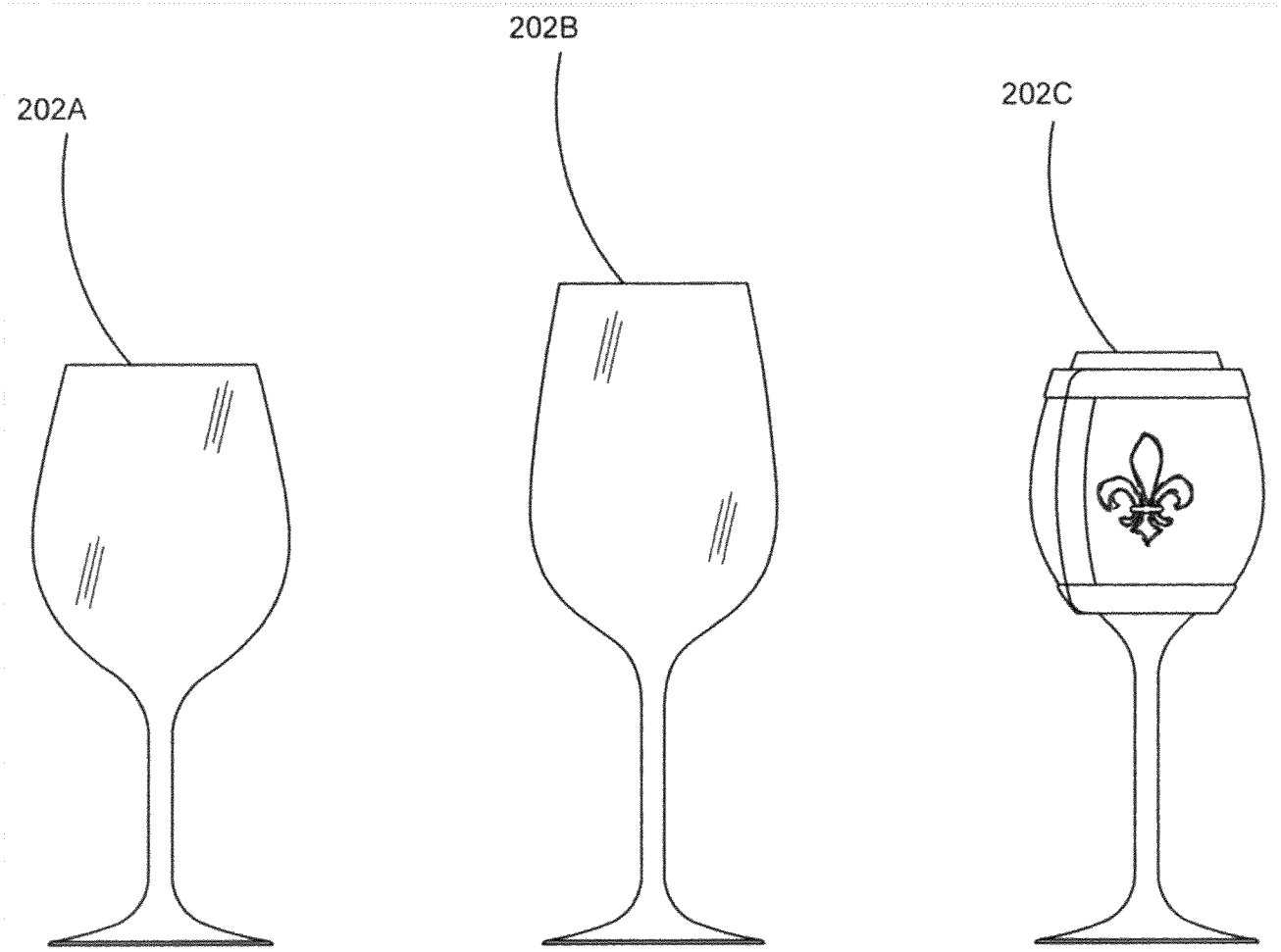

FIGS. 2A, 2B, and 2C show the insulated glass beverage wrap of FIGS. 1A-1B placed on various sized beverage glasses, in accordance with some embodiments of the inventive disclosure. There are three different beverage glasses 202A, 202B, and 202C shown. The insulated glass beverage wrap is shown around the first glass 202A in FIG. 2A, around the second glass 202B in FIG. 2B, and around the third glass 202C in FIG. 2C. Because the body 102 can stretch, the insulated glass beverage wrap an be placed on a variety of differently-sized and shaped glasses. In this series, for example, the second glass 202B has a slightly squared bottom compared to the first glass 202A, and it is slightly taller than the first glass 202A.

Figure 3:
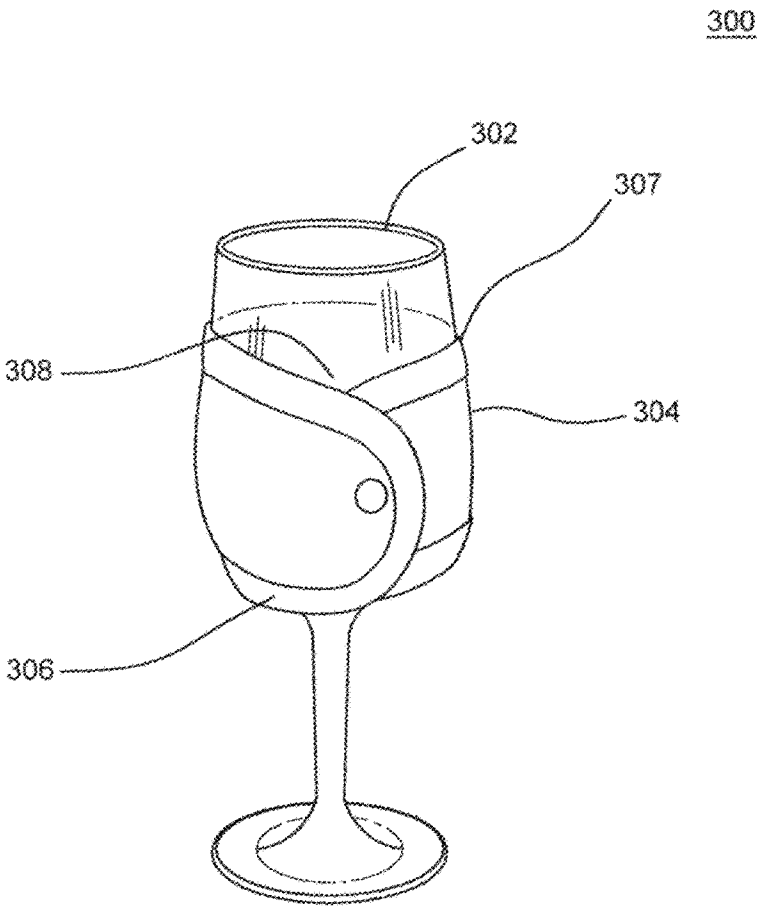
FIG. 3 shows a view of an insulated glass beverage wrap placed on a wine glass, in accordance with some embodiments of the inventive disclosure.

FIG. 3 shows a view of an insulated glass beverage wrap 300 placed on a wine glass 302, in accordance with some embodiments of the inventive disclosure. The body 304 can be substantially the same as that shown in FIGS. 1A-1B, with the ends overlapping to mate the closure structures together. The bottom edge 306 is not as stretched at the top edge 307, and given the slightly inverted conical shape of the wine glass 302, the body will generally stay in place on the glass. The rounded ends, when overlapped, create a "V" shaped notch 308 or valley around the top edge 307. This notch 308 provides room for a person the drink from the glass 302 without placing their lips in the body 304 of the insulated glass beverage wrap. The lower or bottom edge 306, not being a stretched as the top edge 307, will cover a substantial portion of the bottom of the glass 302 and be located further inward relative to the top edge 307.

Figure 4:
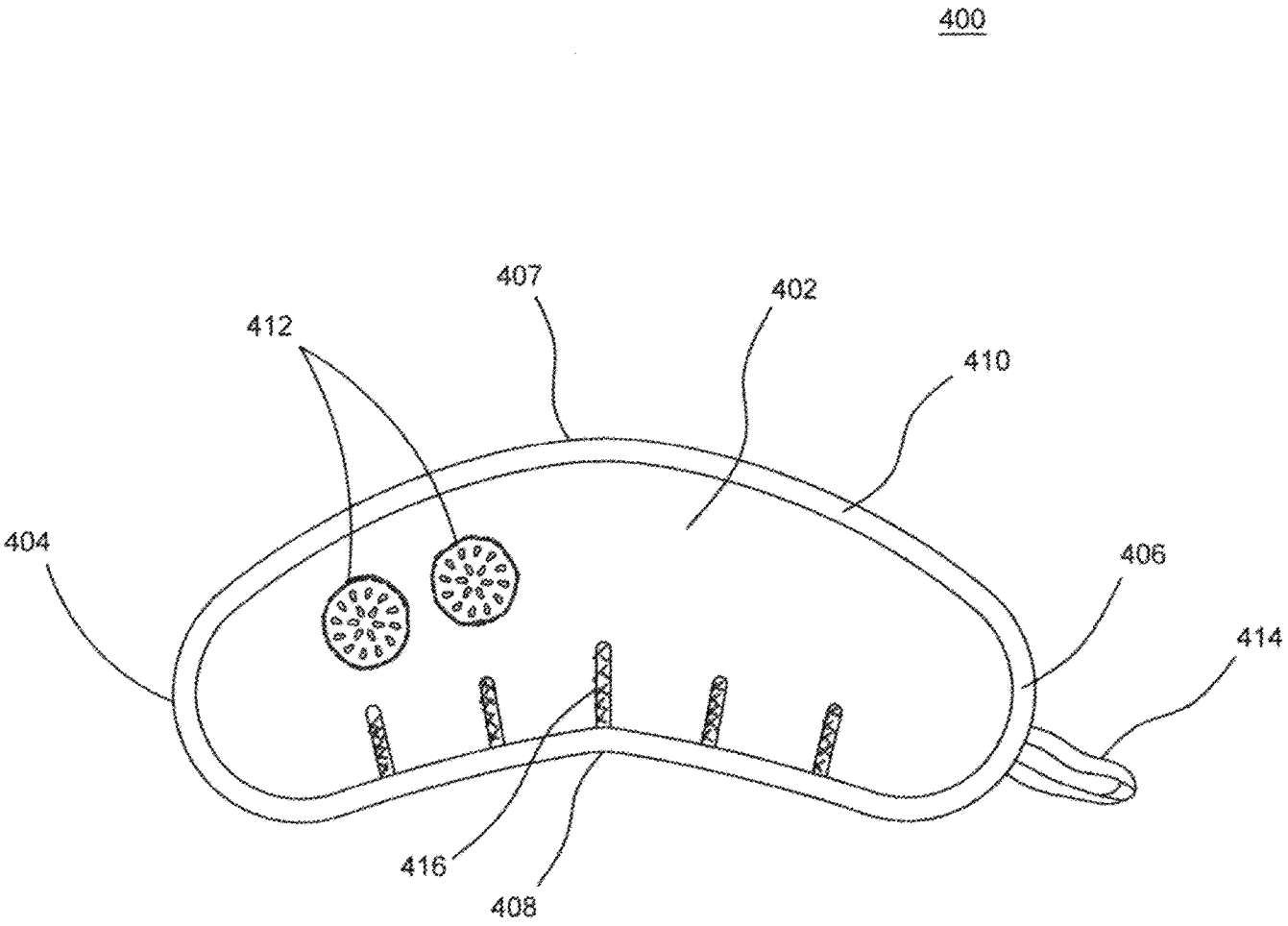
FIG. 4 shows a plan view of an insulated glass beverage wrap, in accordance with some embodiments of the inventive disclosure.

FIG. 4 shows a plan view of an insulated glass beverage wrap 400, in accordance with some embodiments of the inventive disclosure. The wrap 400 includes a body 402 that can be substantially similar to the material of the wrap shown in FIGS. 1A-1B. The body 402 includes a first end 402, and a second end 406. The ends 404, 406 are the terminal portions of the body 402 in the elongated direction of the body 402. The ends 404, 406 are rounded, even following a semi-circular shape. The top edge 407 is more arcuate that previous wrap, as is the bottom edge 408. The downward arc of the top edge 407 towards the ends 404, 406 creates more a "V" shape when the ends are overlapping and the body 402 is wrapped around a glass. In this example the body 402 can have one or more pleats sewn into the body 402 at the bottom edge 408, extending from the bottom edge 408 toward the top edge 407. The pleats can extend approximately ten to fifty percent into the body, from the bottom edge 408 toward the top edge 407. The pleats 416 change the degree to which the bottom edge 408 will stretch relative to the top edge 407 to ensure that the top edge 407, when the body 402 is wrapped around a glass, will be retained on the glass through simple friction, and the bottom edge 408 will cover more of the bottom of the glass, at least when the glass is a wine glass type glass, or stemware in general. The body 402 also includes a cuff 410 around the perimeter of the body 402.

Figure 5A:
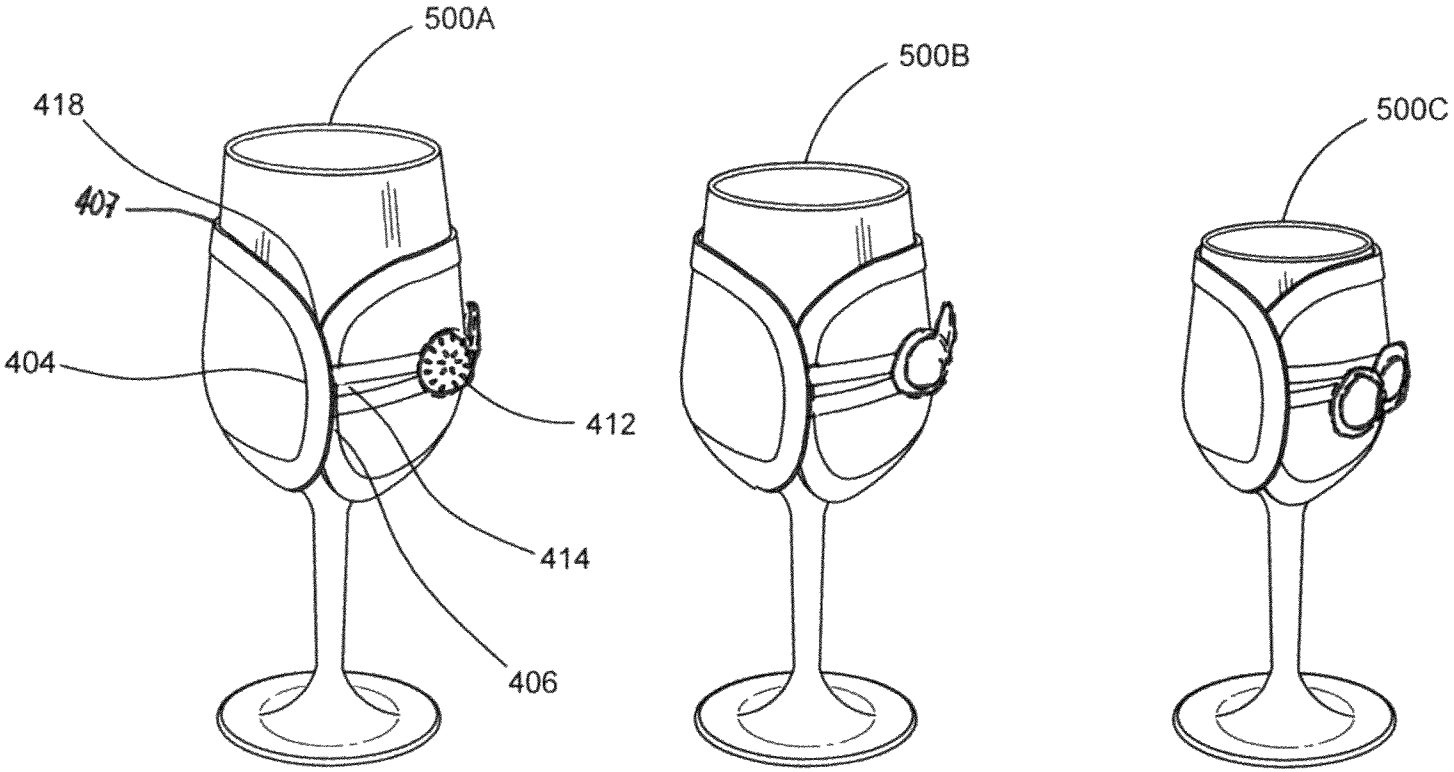
FIGS. 5A, 5B show opposite sides of beverage glasses wrapped with insulated glass beverage wraps, in accordance with some embodiments of the inventive disclosure.
Figure 5B:
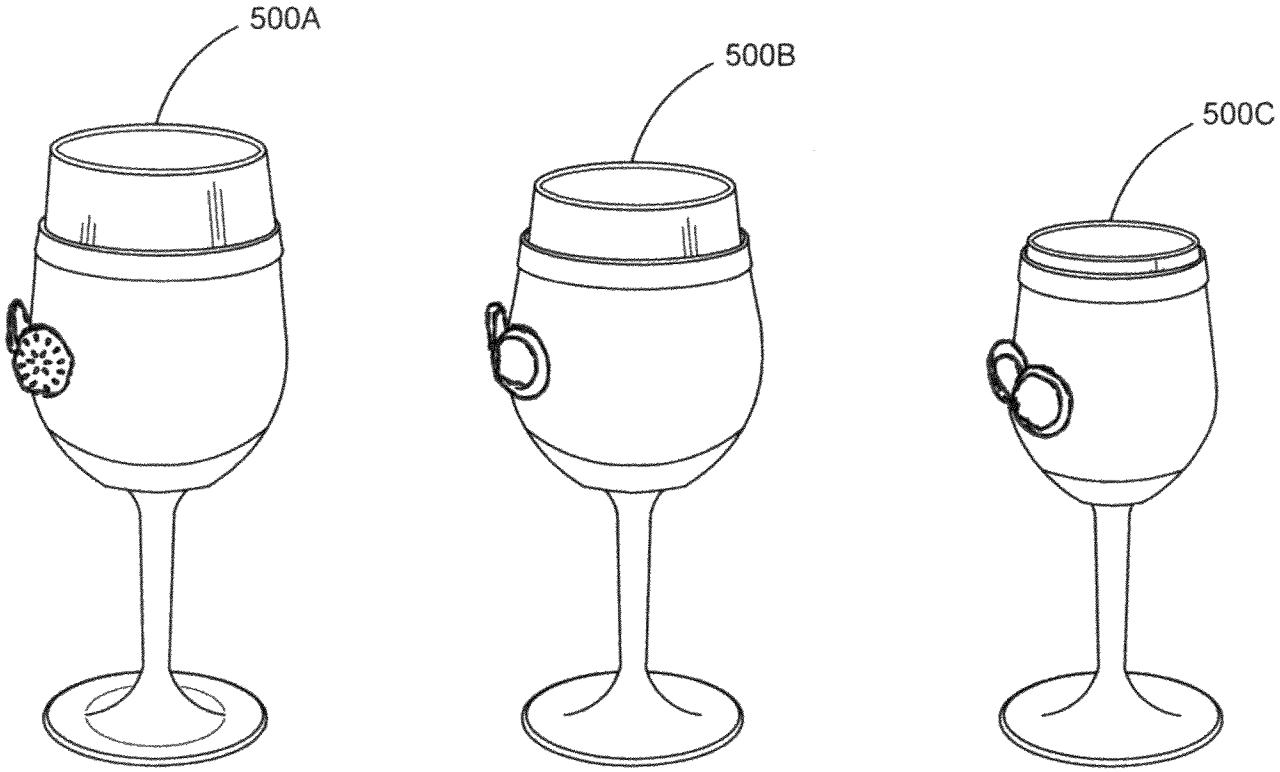

Further, whereas previous bodies used hook and loop fasteners, the present example uses buttons 412 and a loop 414. The loop 414 can be an elastic loop positioned at the second end, sewn onto the second end. On the outward facing side, one or more buttons 412 can be placed near the first end 404, or on the half of the body 402 closest to the first end. The buttons 412 can be arranged in a series along the elongated direction of the body to accommodate various sizes of glasses. To be wrapped by the body 402. The use cases of the body 402 is shown in FIGS. 5A-5B. FIGS. 5A, 5B show opposite sides of beverage glasses 500A, 500B, 500C wrapped with insulated glass beverage wraps, in accordance with some embodiments of the inventive disclosure. The loop 414 is placed over button 412 to hold the body 402 on the wine glass (e.g. 500A). As can be seen, the shape of the ends 404, 406, being rounded, creates a substantial "V" notch 418 that is wider than the inverted "V" notch along the bottom edge. The notch 418 can provide a sipping/drinking location so that the person using the glass 500A and wrap does not have to place their mouth on the wrap. The bottom of the wrap extends inward toward the vertical center axis of the glass more that the top edge 407 does, and covers more of the bottom of the glass 500A. The benefit of the notch 418 can especially be seen on glass 500C where the top edge of the wrap around that glass meets the rim of the glass for a substantial portion around the rim of the glass 500C. FIG. 5B shows the opposite side of the glasses 500A-C and their respective wraps. Thus, the same sized wrap can be used on multiple different glasses of different sizes and shapes.

Figure 6B:
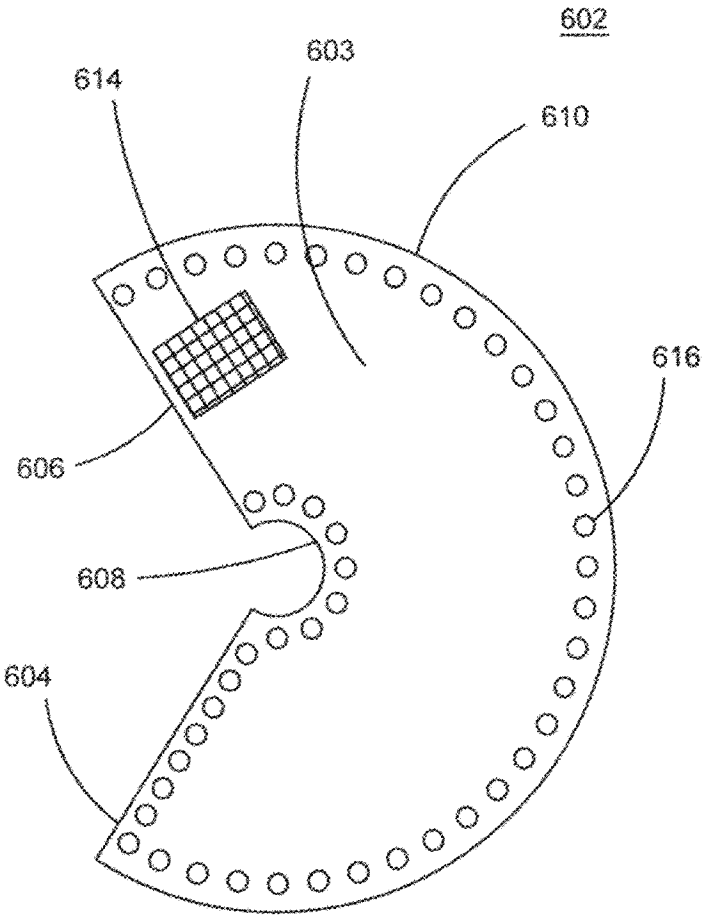
FIGS. 6A, 6B show plan view of opposite sides of an insulated glass beverage wrap configured for conically-shaped glasses, in accordance with some embodiments of the inventive disclosure.
Figure 6A:
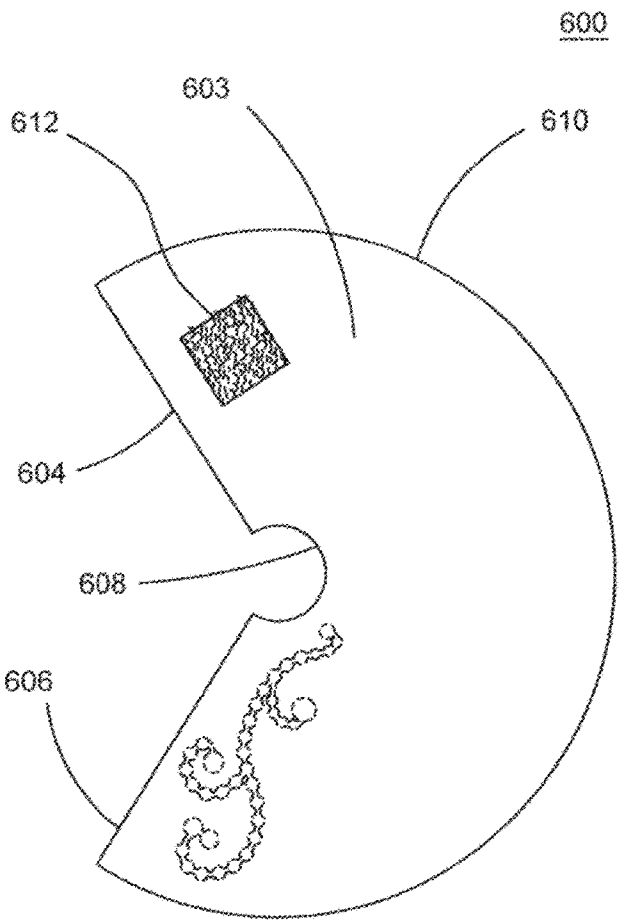
Figure 7:
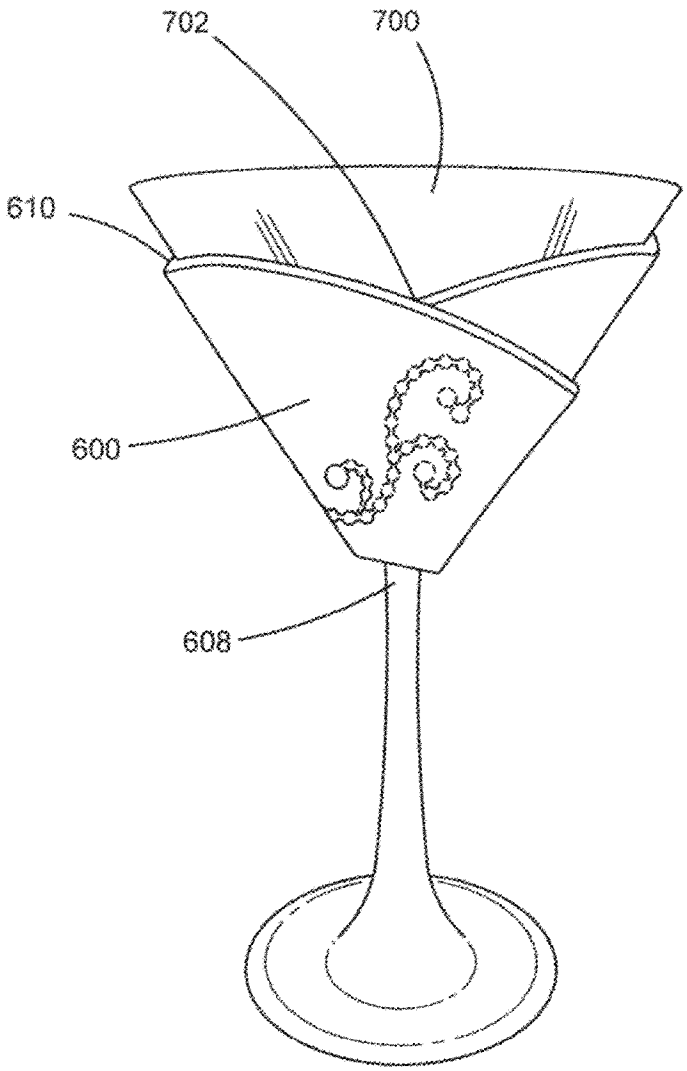
FIG. 7 shows the insulated glass beverage wrap of FIGS. 6A-6B placed on a conically-shaped beverage glass, in accordance with some embodiments of the inventive disclosure.

FIGS. 6A, 6B show plan views of opposite sides 600, 602 of an insulated glass beverage wrap configured for conically-shaped glasses, in accordance with some embodiments of the inventive disclosure. In particular, this wrap is suitable for what are known as martini glasses. The wrap has a body 603 that includes a first end 604 and a second end 606. As can be seen, the body 603 has a crescent or "C" shape. The body 603 includes a bottom edge 608 that is substantially smaller than the top edge 610. The top edge, in a path around the perimeter of the body 603 from the first end 604 to the second end 606 can be five to ten times longer than the length around the bottom edge 608. The first side 600 includes a first closure structure 612 that can be a portion of loop-fabric for a hook and loop closure. Accordingly, the second side 402 includes a hook-fabric portion 614 as a second closure structure that will mate with first closure structure 612. Further, the top edge 610 turns slightly inward as it approaches the ends 604, 606 to provide the desired "V" notch when the body 603 is wrapped around a glass. On the second side 602 that can also be some rubber elements 616 that are for gripping the external surface of the glass when the body 603 is wrapped around a glass, as shown in FIG. 7. FIG. 7 shows the insulated glass beverage wrap of FIGS. 6A-6B placed on a conically-shaped beverage glass 700, in accordance with some embodiments of the inventive disclosure. As can be seen the glass is conically shaped in the well-known style of a martini glass. The glass has a conic-shaped body 704, a stem 706, and a base 708, wherein the stem 706 extends from the bottom of the conic-shaped body 704 to the base 708. The top edge forms a "V" notch 702 where the ends 604, 606 overlap, and the first and second closure structures are mated together. Because of the small size of the bottom edge 608, the bottom edge can be in stretched contact with the stem of the glass to add further holding grip/friction to keep the body 603 on the glass.

Figure 8B:
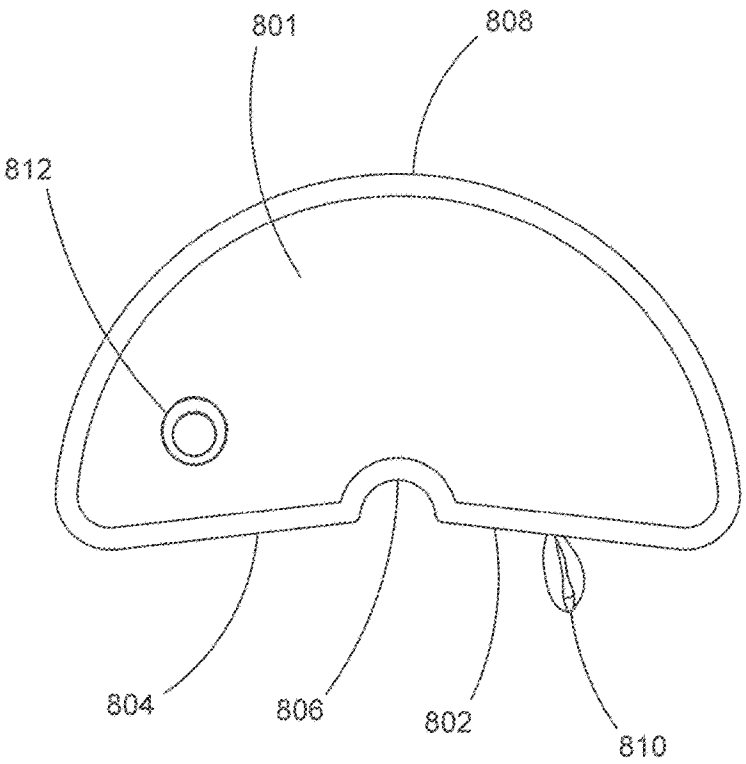
FIGS. 8A-8B shows plan views of opposite sides of an insulated glass beverage wrap for conically-shaped beverage glasses, including suction cups, in accordance with some embodiments of the inventive disclosure.
Figure 8A:
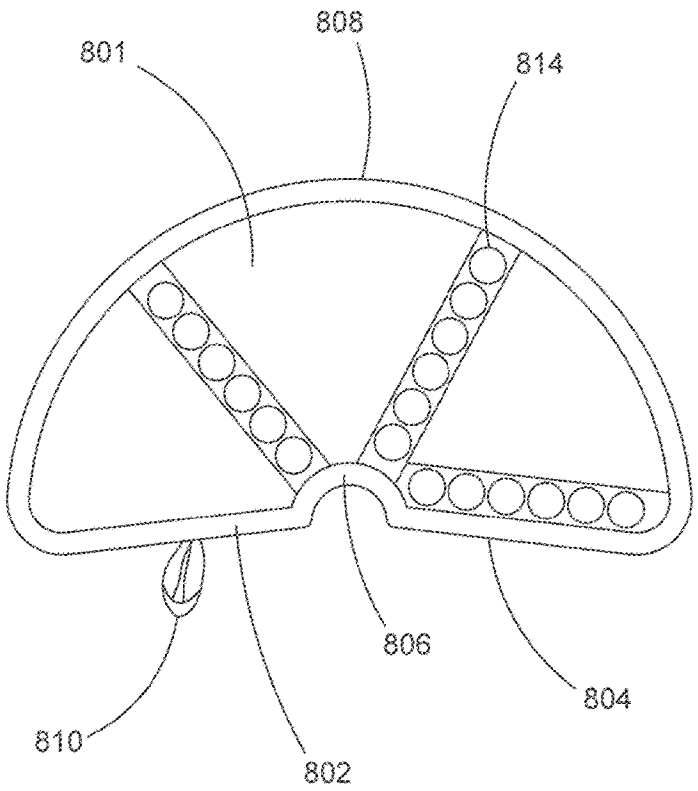

FIGS. 8A-8B shows plan views of opposite sides 800A, 800B of an insulated glass beverage wrap for conically-shaped beverage glasses, including suction cups, in accordance with some embodiments of the inventive disclosure. The crescent-shaped body 801 includes a first end 802 and a second end 804. A bottom edge 806 has a much shorter length, around the perimeter of the body 801 from the first end 802 to the second end 804 than does the top edge 808. As a closure structure, the body 801 includes a loop 810 at the first end 802, and a button 812 on the second (external or outward-facing) side 800B. In addition, there can be one or more small suction cups 814 arranged on the first side 800A to adhere through suction to the external surface of the glass around which the body 801 is wrapped. As shown here, the suction cops 814 can be arranged in one or more lines extending from the bottom edge 806 to the top edge 808. In some embodiments a line of suction cups 814 can be provided along the second end 804 (or equivalently along the first end 802) between the bottom edge 806 and the top edge 808. In some embodiments there can be one to three lines of suction cups 814 spaced approximately equidistant apart from each other, along radial lines between the bottom edge 806 and the top edge 808.

Figure 9:
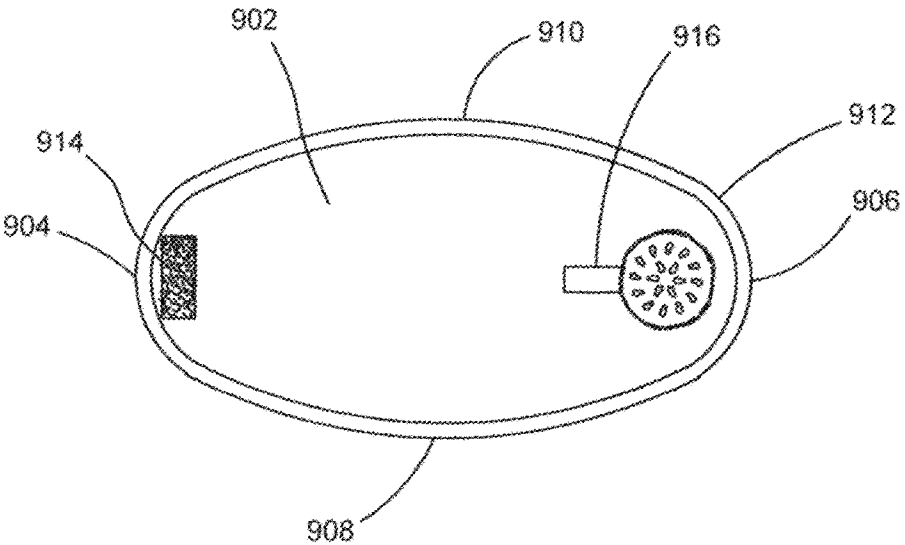
FIG. 9 shows a plan view of an insulated glass beverage wrap having an ovaline body, in accordance with some embodiments of the inventive disclosure.

FIG. 9 shows a plan view of an insulated glass beverage wrap 900 having an ovaline body 902, in accordance with some embodiments of the inventive disclosure. The body 902 has an elongated direction from a first end 904 to a second end 906. In this case, the top edge 910 can have a length that is substantially equal to the length of the bottom edge from the first end 904 to the second end 906. The ends 904, 906 are very rounded in the outward direction from each other in the elongated direction. The side shown includes a decorative indicia 912, such as a button, that can mimic buttons on cocktail attire (e.g. blazers, suit jackets).

Figure 10:
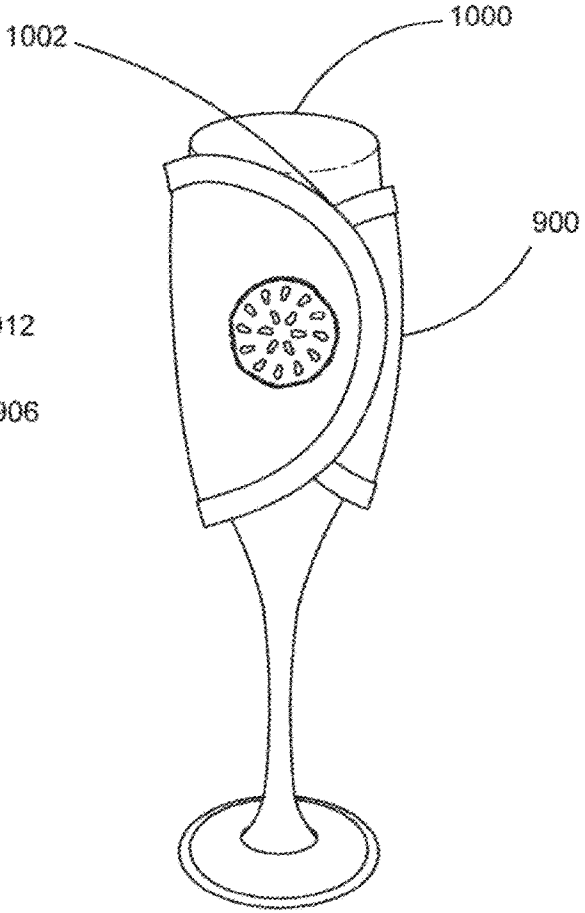
FIG. 10 shows a beverage glass with the insulated glass beverage wrap of FIG. 9 placed thereon, in accordance with some embodiments of the inventive disclosure.

FIG. 10 shows a beverage glass 1000 with the insulated glass beverage wrap of FIG. 9 placed thereon, in accordance with some embodiments of the inventive disclosure. The first closure structure 914 is mated to a second closure structure (not shown) on the opposite side from FIG. 9, and can be sewn to the body using stitches 916. The second closure structure can be oriented in the elongated direction of the body so as to accommodate various sized glasses. The rounded ends 904, 906 again create the "V" notch 1002 to allow a person to drink from the glass without having to put their mouth/lips on the body 902 of the wrap.

An insulated glass beverage wrap has been disclosed and described that provides the benefits of being able to be adjusted to different sized and shaped glasses, and the be retained on the glass. The insulated glass beverage wrap prevents the user's hands from getting wet due to condensation, and can greatly diminish the amount of condensation by covering a large portion of the glass. The disclosed wrap also provides a notch by shaping the ends of the body of the wrap such that when the ends are overlapped around a glass, there is a space (notch) that allows for unimpeded drinking from the glass. When the beverage is finished, the user can simply remove the wrap from the glass for washing/cleaning and/or use on another glass. The insulative properties of the body prevent heat from the user's hand to warm up the beverage, as well.

The claims appended hereto are meant to cover all modifications and changes within the scope and spirit of the present invention.

What is claimed is:

1. An insulated beverage glass wrap, comprising:

a body comprised of a sheet of an insulating material and including a first side and a second side;

the body having a first end and a second end that is opposite the first end in an elongated direction of the body;

a top edge along a top of the body from the first end to the second end;

a bottom edge along a bottom of the body from the first end to the second end;

a first closure structure positioned on the body adjacent the first end;

a second closure structure positioned on the body adjacent the second end and that is configured to engage the first closure structure;

at least one suction cup on the first side of the body that is configured to hold the body to an external surface of the beverage glass when the body is wrapped around the beverage glass with the first side of the body against the external surface of the beverage glass; and wherein the body is configured to be wrapped around a beverage glass such that the first side is against an external surface of the beverage glass and the first end and the second end meet such that the second closure structure is engaged with the first closure structure to thereby retain the insulated beverage glass wrap on the beverage glass.

2. The insulated beverage glass wrap of claim 1, wherein the first end and the second end of the body are rounded in a semi-circle from the top edge to the bottom edge such that when the insulated beverage glass wrap is wrapped around the beverage glass there is a downward deviation along the top edge, extending downward to the first end and the second end, where the first end and second end meet to provide a drinking location.

3. The insulated beverage glass wrap of claim 1, wherein the first closure structure a plurality of buttons disposed on the second side of the body, and the second closure structure is a loop, and wherein each button of the plurality of buttons is positioned at different positions along the body.

4. The insulated beverage glass wrap of claim 1, wherein the top edge has a length that is five to ten times longer than the bottom edge.

5. The insulated beverage glass wrap of claim 1, wherein the top edge is at least five times as long as the bottom edge, and wherein the beverage glass is a martini glass.

6. The insulated beverage glass wrap of claim 5, wherein the at least one suction cup comprises at least two rows of suction cups where each row extends from the bottom edge to the top edge.

7. An insulated beverage glass wrap, comprising:

a body comprised of a sheet of an insulating, moisture impermeable material and including a fabric sheath around the insulating, moisture impermeable material, and having a first side and a second side;

the body having a first end and a second end that is opposite the first end;

a top edge along a top of the body from the first end to the second end, wherein the body is rounded where the top edge transitions to the first end, and the body is rounded where the top edge transitions to the second end, wherein the first end and the second end follow a semi-circular shape from the top edge to the bottom edge;

a bottom edge along a bottom of the body from the first end to the second end;

a first closure structure positioned on the body adjacent the first end;

a second closure structure positioned on the body adjacent the second end that is configured to engage the first closure structure; and wherein the body is configured to be wrapped around a beverage glass such that the first side is against an external surface of the beverage glass and the first end and the second end meet such that the second closure structure is engaged with the first closure structure to thereby retain the insulated beverage glass wrap on the beverage glass, and wherein a "V" shaped notch is formed by the body at an overlap of the first end and the second end, extending downward from the top edge to the first end and the second end, to form a drinking location between a top rim of the beverage glass and the body.

8. The insulated beverage glass wrap of claim 7, wherein the first closure structure a plurality of buttons disposed on the second side of the body, and the second closure structure is a loop, and wherein each button of the plurality of buttons is positioned at different positions along the body.

9. The insulated beverage glass wrap of claim 7, wherein the bottom edge has a shorter length from the first end to the second end than the top edge.

10. The insulated beverage glass wrap of claim 7, wherein the top edge is at least five times as long as the bottom edge, and wherein the beverage glass is a martini glass.

11. The insulated beverage glass wrap of claim 10, further comprising at least one suction cup on the first side of the body that is configured to hold the body to the external surface of the martini glass.

12. The insulated beverage glass wrap of claim 7, further comprising at least one suction cup on the first side of the body that is configured to hold the body to an external surface of the beverage glass when the body is wrapped around the beverage glass with the first side of the body against the external surface of the beverage glass.

13. The insulated beverage glass wrap of claim 12, wherein the at least one suction cup comprises at least two rows of suction cups where each row extends from the bottom edge to the top edge.

14. An insulated martini glass wrap, comprising:

a body comprised of a sheet of an insulating material and including a first side and a second side;

the body having a "C" shape and having a first end and a second end;

a top edge along a top of the body from the first end to the second end;

a bottom edge along a bottom of the body from the first end to the second end, wherein the top edge and the bottom edge both have a "C" shape;

a first closure structure positioned on the body adjacent the first end;

a second closure structure positioned on the body adjacent the second end and that is configured to engage the first closure structure;

at least one suction cup on the first side of the body that is configured to hold the body to an external surface of the beverage glass when the body is wrapped around the beverage glass with the first side of the body against the external surface of the beverage glass; and wherein the body is configured to be wrapped around a beverage glass such that the first side is against an external surface of the beverage glass and the first end and the second end meet such that the second closure structure is engaged with the first closure structure to thereby retain the insulated beverage glass wrap on the beverage glass, and wherein the bottom edge is configured to be in contact with a stem of the martini glass while the body is wrapped around a conic body of the martini glass.

* * * * *